US010515747B2

(12) United States Patent
Hirota et al.

(10) Patent No.: US 10,515,747 B2
(45) **Date of Patent: *Dec. 24, 2019**

(54) R-FE-B SINTERED MAGNET AND MAKING METHOD

(71) Applicant: Shin-Etsu Chemical Co., Ltd., Tokyo (JP)

(72) Inventors: Koichi Hirota, Echizen (JP); Hiroaki Nagata, Echizen (JP); Tetsuya Kume, Echizen (JP); Hajime Nakamura, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 406 days.

This patent is subject to a terminal disclaimer.

(21) Appl. No.: 15/087,108

(22) Filed: Mar. 31, 2016

(65) Prior Publication Data

US 2016/0293303 A1 Oct. 6, 2016

(30) Foreign Application Priority Data

Mar. 31, 2015 (JP) ..... 2015-072287
Feb. 15, 2016 (JP) ..... 2016-025531

(51) Int. Cl.
*B22F 3/24* (2006.01)
*H01F 1/053* (2006.01)
(Continued)

(52) U.S. Cl.
CPC ..... *H01F 1/0536* (2013.01); *B22F 3/24* (2013.01); *B22F 9/023* (2013.01); *B22F 9/04* (2013.01);
(Continued)

(58) Field of Classification Search
CPC ..... B22F 3/24; H01F 1/0536
See application file for complete search history.

(56) References Cited

U.S. PATENT DOCUMENTS 7,090,730 B2 8/2006 Nomura et al.
2004/0094237 A1* 5/2004 Nomura ..... H01F 1/0577 148/302
(Continued)

FOREIGN PATENT DOCUMENTS

DE 199 45 942 A1 4/2001
EP 0 945 878 A1 9/1999
(Continued)

OTHER PUBLICATIONS

Kyoung-Hoon Bae et al., "Effect of WS2/Al co-doping on microstructural and magnetic properties of Nd-Fe-B sintered magnets." Journal of Alloys and Compounds 673, pp. 321-326. (Year: 2016).*
(Continued)

*Primary Examiner* — Patricia L. Hailey
(74) *Attorney, Agent, or Firm* — Westerman, Hattori, Daniels & Adrian, LLP

(57) ABSTRACT

The invention provides an R—Fe—B sintered magnet consisting essentially of 12-17 at % of Nd, Pr and R, 0.1-3 at % of $M_1$, 0.05-0.5 at % of $M_2$, 4.8+2*m to 5.9+2*m at % of B, and the balance of Fe, containing $R_2(Fe,(Co))_{14}B$ intermetallic compound as a main phase, and having a core/shell structure that the main phase is covered with a grain boundary phases. The sintered magnet has an average grain size of less than 6 μm, a crystal orientation of more than 98%, and a degree of magnetization of more than 96%, and exhibits a coercivity of at least 10 kOe despite a low or nil content of Dy, Tb, and Ho.

8 Claims, 3 Drawing Sheets

(51) Int. Cl.

| | |
|---|---|
| ***B22F 9/02*** | (2006.01) |
| ***B22F 9/04*** | (2006.01) |
| ***H01F 1/057*** | (2006.01) |
| ***H01F 41/02*** | (2006.01) |
| ***C22C 33/02*** | (2006.01) |

(52) U.S. Cl.
CPC ..... *C22C 33/0278* (2013.01); *H01F 1/0577* (2013.01); *H01F 41/0253* (2013.01); *H01F 41/0266* (2013.01); *B22F 2998/10* (2013.01); *B22F 2999/00* (2013.01); *C22C 2202/02* (2013.01); *H01F 1/0573* (2013.01); *H01F 41/0293* (2013.01)

(56) References Cited

U.S. PATENT DOCUMENTS

| | | | | |
|---|---|---|---|---|
| 2013/0009503 | A1 | 1/2013 | Iwasaki et al. | |
| 2014/0132377 | A1 | 5/2014 | Nakajima et al. | |
| 2014/0191831 | A1 | 7/2014 | Yamazaki et al. | |
| 2014/0290803 | A1 | 10/2014 | Kato et al. | |
| 2016/0293304 | A1* | 10/2016 | Hirota | H01F 1/0536 |
| 2016/0293307 | A1* | 10/2016 | Hirota | H01F 41/0266 |
| 2016/0300648 | A1* | 10/2016 | Nagata | H01F 1/057 |
| 2017/0140856 | A1* | 5/2017 | Hirota | B22F 3/24 |
| 2017/0365384 | A1* | 12/2017 | Hirota | H01F 1/059 |
| 2018/0090249 | A1* | 3/2018 | Ohashi | B22F 3/16 |
| 2018/0090250 | A1* | 3/2018 | Ohashi | B22F 3/16 |

FOREIGN PATENT DOCUMENTS

| | | | | |
|---|---|---|---|---|
| EP | 1 214 720 | A1 | 6/2002 | |
| EP | 1 420 418 | A1 | 5/2004 | |
| JP | 07-240308 | * | 9/1995 | H01F 1/08 |
| JP | 7-240308 | | 9/1995 | |
| JP | 2003-510467 | A | 3/2003 | |
| JP | 3997413 | B2 | 10/2007 | |
| JP | 2011-211071 | A | 10/2011 | |
| JP | 2014-132628 | A | 7/2014 | |
| JP | 2014-146788 | A | 8/2014 | |
| JP | 5572673 | B2 | 8/2014 | |
| JP | 2014-209546 | A | 11/2014 | |
| WO | 2014/157448 | A1 | 10/2014 | |
| WO | 2014/157451 | A1 | 10/2014 | |

OTHER PUBLICATIONS

Extended European Search Report dated Aug. 4, 2016, issued in counterpart Application No. 16163097.5. (8 pages).
Office Action dated Nov. 13, 2018, issued in counterpart Japanese Application No. 2016-064966, with English machine translation. (6 pages).

* cited by examiner

R-FE-B SINTERED MAGNET AND MAKING METHOD

CROSS-REFERENCE TO RELATED APPLICATION

This non-provisional application claims priority under 35 U.S.C. § 119(a) on Patent Application Nos. 2015-072287 and 2016-025531 filed in Japan on Mar. 31, 2015 and Feb. 15, 2016, respectively, the entire contents of which are hereby incorporated by reference.

TECHNICAL FIELD

This invention relates to an R—Fe—B base sintered magnet having a high coercivity and a method for preparing the same.

BACKGROUND ART

While Nd—Fe—B sintered magnets, referred to as Nd magnets, hereinafter, are regarded as the functional material necessary for energy saving and performance improvement, their application range and production volume are expanding every year. Since many applications are used in high temperature, the Nd magnets are required to have not only a high remanence but also a high coercivity. On the other hand, since the coercivity of Nd magnets are easy to decrease significantly at a elevated temperature, the coercivity at room temperature must be increased enough to maintain a certain coercivity at a working temperature.

As the means for increasing the coercivity of Nd magnets, it is effective to substitute Dy or Tb for part of Nd in $Nd_2Fe_{14}B$ compound as main phase. For these elements, there are short resource reserves in the world, the commercial mining areas in operation are limited, and geopolitical risks are involved. These factors indicate the risk that the price is unstable or largely fluctuates. Under the circumstances, the development for a new process and a new composition of R—Fe—B magnets with a high corecivity, which include a minimizing the content of Dy and Tb, is required.

From this standpoint, several methods are already proposed. Patent Document 1 discloses an R—Fe—B base sintered magnet having a composition of 12-17 at % of R (wherein R stands for at least two of yttrium and rare earth elements and essentially contains Nd and Pr), 0.1-3 at % of Si, 5-5.9 at % of B, 0-10 at % of Co, and the balance of Fe (with the proviso that up to 3 at % of Fe may be substituted by at least one element selected from among Al, Ti, V, Cr, Mn, Ni, Cu, Zn, Ga, Ge, Zr, Nb, Mo, In, Sn, Sb, Hf, Ta, W, Pt, Au, Hg, Pb, and Bi), containing a $R_2(Fe,(Co),Si)_{14}B$ intermetallic compound as main phase, and exhibiting a coercivity of at least 10 kOe. Further, the magnet is free of a B-rich phase and contains at least 1 vol % based on the entire magnet of an R—Fe(Co)—Si phase consisting essentially of 25-35 at % of R, 2-8 at % of Si, up to 8 at % of Co, and the balance of Fe. During sintering or post-sintering heat treatment, the sintered magnet is cooled at a rate of 0.1 to 5° C./min at least in a temperature range from 700° C. to 500° C., or cooled in multiple stages including holding at a certain temperature for at least 30 minutes on the way of cooling, for thereby generating the R—Fe(Co)—Si phase in grain boundary.

Patent Document 2 discloses a Nd—Fe—B alloy with a low boron content, a sintered magnet prepared by the alloys, and their process. In the sintering process, the magnet is quenched after sintering below 300° C., and an average cooling rate down to 800° C. is $\Delta T1/\Delta\mu l<5K/min$.

Patent Document 3 discloses an R-T-B magnet comprising $R_2Fe_{14}B$ main phase and some grain boundary phases. One of grain boundary phase is R-rich phase with more R than the main phase and another is Transition Metal-rich phase with a lower rare earth and a higher transition metal concentration than that of main phase. The R-T-B rare earth sintered magnet is prepared by sintering at 800 to 1,200° C. and heat-treating at 400 to 800° C.

Patent Document 4 discloses an R-T-B rare earth sintered magnet comprising a grain boundary phase containing an R-rich phase having a total atomic concentration of rare earth elements of at least 70 at % and a ferromagnetic transition metal-rich phase having a total atomic concentration of rare earth elements of 25 to 35 at %, wherein an area proportion of the transition metal-rich phase is at least 40% of the grain boundary phase. The green body of magnet alloy powders is sintered at 800 to 1,200° C., and then heat-treated with multiple steps. First heat-treatment is in the range of 650 to 900° C., then sintered magnet is cooled down to 200° C. or below, and second heat-treatment is in range of at 450 to 600° C.

Patent Document 5 discloses an R-T-B rare earth sintered magnet comprising a main phase of $R_2Fe_{14}B$ and a grain boundary phase containing more R than that of the main phase, wherein easy axis of magnetization of $R_2Fe_{14}B$ compound is in parallel to the c-axis, the shape of the crystal grain of $R_2Fe_{14}B$ phase is elliptical shape elongated in a perpendicular direction to the c-axis, and the grain boundary phase contains an R-rich phase having a total atomic concentration of rare earth elements of at least 70 at % and a transition metal-rich phase having a total atomic concentration of rare earth elements of 25 to 35 at %. It is also described that magnet are sintered at 800 to 1,200° C. and subsequent heat treatment at 400 to 800° C. in an argon atmosphere.

Patent Document 6 discloses a rare earth magnet comprising $R_2T_{14}B$ main phase and an intergranular grain boundary phase, wherein the intergranular grain boundary phase has a thickness of 5 nm to 500 nm and the magnetism of the phase is not ferromagnetism. It is described that the intergranular grain boundary phase is formed from a non-ferromagnetic compound due to add element M such as Al, Ge, Si, Sn or Ga, though this phase contains the transition metal elements. Furthermore by adding Cu to the magnet, a crystalline phase with a $La_6Co_{11}Ga_3$-type crystal structure can be uniformly and widely formed as the intergranular grain boundary phase, and a thin R—Cu layer may be formed at the interface between the $La_6Co_{11}Ga_3$-type grain boundary phase and the $R_2T_{14}B$ main phase crystal grains. As a result, the interface of the main phase is passivated, a lattice distortion of main phase can be suppressed, and nucleation of the magnetic reversal domain can be inhibited. The method of preparing the magnet involves post-sintering heat treatment at a temperature in the range of 500 to 900° C., and cooling at the rate of least 100° C./min, especially at least 300° C./min.

Patent Document 7 and 8 disclose an R-T-B sintered magnet comprising a main phase of $Nd_2Fe_{14}B$ compound, an intergranular grain boundary which is enclosed between two main phase grains and which has a thickness of 5 nm to 30 nm, and a grain boundary triple junction which is the phase surrounded by three or more main phase grains.

CITATION LIST

Patent Document 1: JP 3997413 (U.S. Pat. No. 7,090,730, EP 1420418)

Patent Document 2: JP-A 2003-510467 (EP 1214720)
Patent Document 3: JP 5572673 (US 20140132377)
Patent Document 4: JP-A 2014-132628
Patent Document 5: JP-A 2014-146788 (US 20140191831)
Patent Document 6: JP-A 2014-209546 (US 20140290803)
Patent Document 7: WO 2014/157448
Patent Document 8: WO 2014/157451

DISCLOSURE OF INVENTION

However, there exists a need for an R—Fe—B sintered magnet which exhibits a high coercivity despite a minimal or nil content of Dy, Tb and Ho.

Recently, interior permanent magnet synchronous motors (IPM) with permanent magnets buried in the rotor, regarded as high-efficiency motors, are widely used in any applications such as compressors for air-conditioning machines, spindles, factory automation machines and hybrid electric vehicles and electric vehicle and so on. In the process of assembling the IPM, the sequence of magnetizing permanent magnet in advance and burying it in a slit in the rotor is less efficient and often causes cracking or chipping defects to the magnet. For this reason, the sequence of burying un-magnetized permanent magnet in the rotor and applying a magnetic field from the stator for magnetizing the permanent magnet is applied. This sequence is more efficient for the productivity, but suffers from the problem that the permanent magnet cannot be fully magnetized because the magnetic field from stator coils is not so high. More recently, the approach of magnetizing the rotor in a special magnetizing machine is installed, but there is a risk that production cost increases. For the purpose of developing an efficient motor at a low cost, an improvement in magnetization of permanent magnets, that is, a reduction of the magnetizing field necessary for full magnetization of magnet is a crucial task.

Therefore, an object of the invention is to provide an R—Fe—B sintered magnet exhibiting a high coercivity and requiring a reduced magnetic field for magnetization, and a method for preparing the same.

The inventors have found that a desired R—Fe—B base sintered magnet can be prepared by a method comprising the steps of shaping an alloy powder consisting essentially of 12 to 17 at % of R, 0.1 to 3 at % of $M_1$, 0.05 to 0.5 at % of $M_2$, 4.8+2×m to 5.9+2×m at % of B, up to 10 at % of Co, and the balance of Fe and having an average particle size of up to 10 μm into a green compact, sintering the green compact, cooling the sintered compact to a temperature of 400° C. or below, post-sintering heat treatment including heating the sintered compact at a temperature in the range of 700 to 1,100° C. which temperature is exceeding peritectic temperature of R—Fe(Co)-$M_1$ phase, and cooling down to a temperature of 400° C. or below at a rate of 5 to 100° C./min, and aging treatment including exposing the sintered compact at a temperature in the range of 400 to 600° C. which temperature is lower than the peritectic temperature of R—Fe(Co)-$M_1$ phase so as to form the R—Fe(Co)-$M_1$ phase at a grain boundary, and cooling down to a temperature of 200° C. or below; or a method comprising the steps of shaping the alloy powder into a green compact, sintering the green compact, cooling the sintered compact down to a temperature of 400° C. or below at a rate of 5 to 100° C./min, and aging treatment including exposing the sintered compact at a temperature in the range of 400 to 600° C. which temperature is lower than the peritectic temperature of R—Fe(Co)-$M_1$ phase so as to form the R—Fe(Co)-$M_1$ phase at a grain boundary, and cooling down to a temperature of 200° C. or below. An average crystal grain size may be controlled to 6 μm or less by restricting the average particle size of the alloy powder, and reducing the oxygen concentration and the water content. Specifically, the average particle size of the alloy powder as finely milled is adjusted to 4.5 μm or less. The R—Fe—B base sintered magnet thus obtained contains $R_2(Fe,(Co))_{14}B$ intermetallic compound as a main phase, contains a $M_2$ boride phase at a grain boundary triple junction, but not including $R_{1.1}Fe_4B_4$ compound phase, and has a core/shell structure that at least 50% of the main phase is covered with an R—Fe(Co)-$M_1$ phase with a width of at least 10 nm and at least 50 nm on the average. The sintered magnet exhibits a coercivity of at least 10 kOe, and has an average grain size of up to 6 μm and a crystal orientation of at least 98%. The sintered magnet requires a magnetizing field of reduced strength and is suited for the magnetization approach of applying a magnetic field from the exterior of the rotor. Continuing experiments to establish appropriate processing conditions and an optimum magnet composition, the inventors have completed the invention.

It is noted that Patent Document 1 recites a low cooling rate after sintering. Even if R—Fe(Co)—Si grain boundary phase forms a grain boundary triple junction, in fact, the R—Fe(Co)—Si grain boundary phase does not enough cover the main phase or form a intergranular grain boundary phase un-continuously. Because of same reason, Patent Document 2 fails to establish the core/shell structure that the main phase is covered with the R—Fe(Co)-$M_1$ grain boundary phase. Patent Document 3 does not refer to the cooling rate after sintering and post-sintering heat treatment, and it does not descript that an intergranular grain boundary phase is formed. The magnet of Patent Document 4 has a grain boundary phase containing R-rich phase and a ferromagnetic transition metal-rich phase with 25 to 35 at % of R, whereas the R—Fe(Co)-$M_1$ phase of the inventive magnet is not a ferromagnetic phase but an anti-ferromagnetic phase. The post-sintering heat treatment in Patent Document 4 is carried out at the temperature below the peritectic temperature of R—Fe(Co)-$M_1$ phase, whereas the post-sintering heat treatment in the invention is carried out at the temperature above the peritectic temperature of R—Fe(Co)-$M_1$ phase.

Patent Document 5 describes that post-sintering heat treatment is carried out at 400 to 800° C. in an argon atmosphere, but it does not refer to the cooling rate. The description of the structure suggests the lack of the core/shell structure that the main phase is covered with the R—Fe(Co)-$M_1$ phase. In Patent Document 6, it is described that the cooling rate of post-sintering heat treatment is preferably at least 100° C./min, especially at least 300° C./min. The sintered magnet above obtained contains crystalline $R_6T_{13}M_1$ phase and amorphous or nano-crystalline R-Cu phase. In this invention, R—Fe(Co)-$M_1$ phase in the sintered magnet shows amorphous or nano-crystalline.

The Patent Document 7 provides the magnet contain the $Nd_2Fe_{14}B$ main phase, an intergralunar grain boundary and a grain boundary triple junction. In addition, the thickness of the intergranular grain boundary is in range of 5 nm to 30 nm. However the thickness of the intergranular grain boundary phase is too small to achieve a sufficient improvement in the coercivity. Patent Document 8 describes in Example section substantially the same method for preparing sintered magnet as Patent Document 7, suggesting that the thickness (phase width) of the intergranular grain boundary phase is small.

In one aspect, the invention provides an R—Fe—B base sintered magnet of a composition consisting essentially of 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta, and W, 4.8+2×m to 5.9+2×m at % of B wherein m stands for atomic concentration of $M_2$, up to 10 at % of Co, up to 0.5 at % of carbon, up to 1.5 at % of oxygen, up to 0.5 at % of nitrogen, and the balance of Fe, containing $R_2(Fe,Co)_{14}B$ intermetallic compounds as a main phase, and having a coercivity of at least 10 kOe at room temperature. The magnet contains a $M_2$ boride phases at grain boundary triple junctions, but not including $R_{1.1}Fe_4B_4$ compound phase, has a core/shell structure that the main phase is covered with grain boundary phases comprising an amorphous and/or sub-10 nm nano-crystalline R—Fe(Co)-$M_1$ phases consisting essentially of 25 to 35 at % of R, 2 to 8 at % of $M_1$, up to 8 at % of Co, and the balance of Fe, or the R—Fe(Co)-$M_1$ phase and a crystalline or a sub-10 nm nano-crystalline and amorphous R-$M_1$ phase having at least 50 at % of R, wherein a surface area coverage of the R—Fe(Co)-$M_1$ phase on the main phase is at least 50%, and the width of the intergranular grain boundary phase is at least 10 nm and at least 50 nm on the average, and the magnet as sintered has an average grain size of up to 6 μm, a crystal orientation of at least 98%, and a degree of magnetization of at least 96%, where the degree of the magnetization is defined as a ratio of magnetic polarizations, (I_a_Pc)/(I_f_Pc), and I_a_Pc stands for a magnetic polarization at Pc=1 after applying 640 kA/m and I_f_Pc stands for a magnetic polarization at Pc=1 after applying 1,590 kA/m. It is provided that R, $M_1$ and $M_2$ are as defined above.

Preferably, in the R—Fe(Co)-$M_1$ phase, $M_1$ consists of 0.5 to 50 at % of Si and the balance of at least one element selected from the group consisting of Al, Mn, Ni, Cu, Zn, Ga, Ge, Pd, Ag, Cd, In, Sn, Sb, Pt, Au, Hg, Pb, and Bi; M; consists of 1.0 to 80 at % of Ga and the balance of at least one element selected from the group consisting of Si, Al, Mn, Ni, Cu, Zn, Ge, Pd, Ag, Cd, In, Sn, Sb, Pt, Au, Hg, Pb, and Bi; or $M_1$ consists of 0.5 to 50 at % of Al and the balance of at least one element selected from the group consisting of Si, Mn, Ni, Cu, Zn, Ga, Ge, Pd, Ag, Cd, In, Sn, Sb, Pt, Au, Hg, Pb, and Bi.

The sintered magnet preferably has a total content of Dy, Tb and Ho which is 0 to 5.0 at %.

Another embodiment is a method for preparing the R—Fe—B base sintered magnet defined above, comprising the steps of: shaping an alloy powder having an average particle size of up to 10 μm into a green compact, the alloy powder being obtained by finely pulverizing an alloy consisting essentially of 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta and W, 4.8+2×m to 5.9+2×m at % of B wherein m stands for atomic concentration of $M_2$, up to 10 at % of Co, and the balance of Fe, sintering the green compact at a temperature of 1,000 to 1,150° C., cooling the sintered compact to a temperature of 400° C. or below, post-sintering heat treatment including heating the sintered compact at a temperature in the range of 700 to 1,100° C. which temperature is exceeding peritectic temperature of R—Fe(Co)-$M_1$ phase, and cooling down to a temperature of 400° C. or below at a rate of 5 to 100° C./min, and aging treatment including exposing the sintered compact at a temperature in the range of 400 to 600° C. which temperature is lower than the peritectic temperature of R—Fe(Co)-$M_1$ phase so as to form the R—Fe(Co)-$M_1$ phase at a grain boundary, and cooling down to a temperature of 200° C. or below.

A further embodiment is a method for preparing the R—Fe—B base sintered magnet defined above, comprising the steps of:

shaping an alloy powder having an average particle size of up to 10 μm as defined above into a green compact, sintering the green compact at a temperature of 1,000 to 1,150° C., cooling the sintered compact to a temperature of 400° C. or below at a rate of 5 to 100° C./min, and aging treatment including exposing the sintered compact at a temperature in the range of 400 to 600° C. which temperature is lower than the peritectic temperature of R—Fe(Co)-$M_1$ phase so as to form the R—Fe(Co)-$M_1$ phase at a grain boundary, and cooling down to a temperature of 200° C. or below.

Preferably, the alloy contains Dy, Tb and Ho in a total amount of 0 to 5.0 at %.

Advantageous Effects of Invention

The R—Fe—B base sintered magnet of the invention exhibits a coercivity of at least 10 kOe despite a low or nil content of Dy, Tb and Ho.

DESCRIPTION OF PREFERRED EMBODIMENTS

Figure 1:
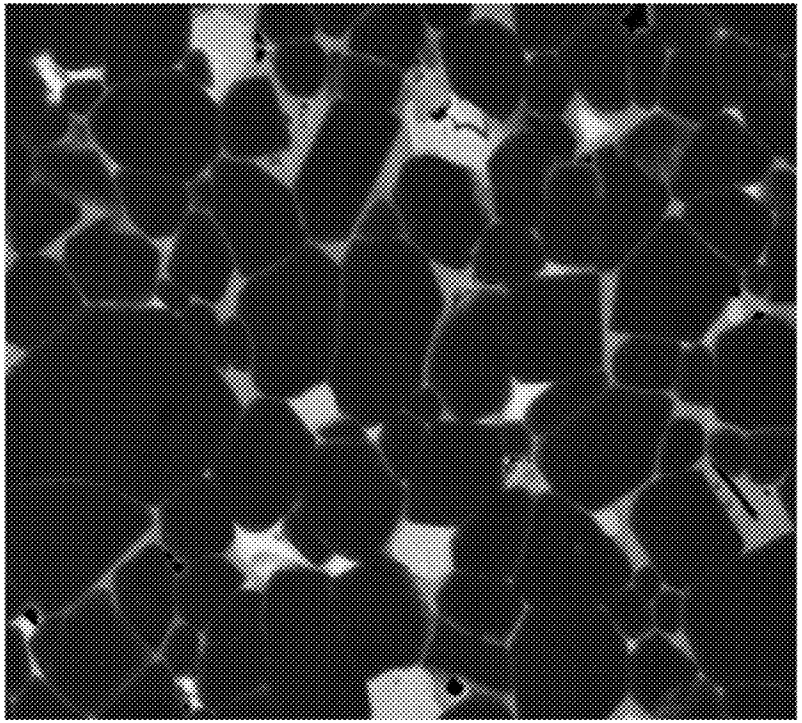
FIG. 1 is a Back scatter electron image (×3000) in cross section of a sintered magnet in Example 1, observed under electron probe microanalyzer (EPMA).

First, the composition of the R—Fe—B sintered magnet is described. The magnet has a composition (expressed in atomic percent) consisting essentially of 12 to 17 at %, preferably 13 to 16 at % of R, 0.1 to 3 at %, preferably 0.5 to 2.5 at % of $M_1$, 0.05 to 0.5 at % of $M_2$, 4.8+2×m to 5.9+2×m at % of B wherein m stands for atomic concentration of $M_2$, up to 10 at % of Co, up to 0.5 at % of carbon, up to 1.5 at % of oxygen, up to 0.5 at % of nitrogen, and the balance of Fe.

Herein, R is at least two of yttrium and rare earth elements and essentially contains neodymium (Nd) and praseodymium (Pr). Preferably the total amount of Nd and Pr account for 80 to 100 at % of R. When the content of R in the sintered magnet is less than 12 at %, the coercivity of the magnet extremely decreases. When the content of R is more than 17 at %, the remanence (residual magnetic flux density, Br) of the magnet extremely decreases. Notably Dy, Tb and Ho may not be contained as R, and if any, the total amount of Dy, Tb and Ho is preferably up to 5.0 at % (i.e., 0 to 5.0 at %), more preferably up to 4.0 at % (i.e., 0 to 4.0 at %), even more preferably up to 2.0 at % (i.e., 0 to 2.0 at %), and especially up to 1.5 at % (i.e., 0 to 1.5 at %).

$M_1$ is at least one element selected from the group consisting of Si, Al, Mn, Ni, Cu, Zn, Ga, Ge, Pd, Ag, Cd, In, Sn, Sb, Pt, Au, Hg, Pb, and Bi. When the content of $M_1$ is less than 0.1 at %, the R—Fe(Co)-$M_1$ grain boundary phase is present in an insufficient proportion to improve the coercivity. When the content of $M_1$ is more than 3 at %, the squareness of the magnet get worse and the remanence of the magnet decreases significantly. The content of $M_1$ is preferably 0.1 to 3 at %.

An element $M_2$ to form a stable boride is added for the purpose of inhibiting abnormal grain growth during sintering. $M_2$ is at least one element selected from the group consisting of Ti, V, Cr, Zr, Nb, Mo, Hf, Ta and W. $M_2$ is desirably added in an amount of 0.05 to 0.5 at %, which enables sintering at a relatively high temperature, leading to improvements in squareness and magnetic properties.

In particular, the upper limit of B is crucial. If the boron (B) content exceeds (5.9+2×m) at % wherein m stands for atomic concentration of $M_2$, the R—Fe(Co)-$M_1$ phase is not formed in grain boundary, but an $R_{1.1}Fe_4B_4$ compound phase, which is so-called B-rich phase, is formed. As long as the inventors' investigation is concerned, when the B-rich phase is present in the magnet, the coercivity of the magnet cannot be enhanced enough. If the B content is less than (4.8+2×m) at %, the percent volume of the main phase is reduced so that magnetic properties of the magnet become worse. For this reason, the B content is better to be (4.8+2×m) to (5.9+2×m) at %, preferably (4.9+2×m) to (5.7+2×m) at %.

The addition of Cobalt (Co) to the magnet is optional. For the purpose of improving Curie temperature and corrosion resistance, Co may substitute for up to 10 at %, preferably up to 5 at % of Fe. Co substitution in excess of 10 at % is undesirable because of a substantial loss of the coercivity of the magnet.

For the inventive magnet, the contents of oxygen, carbon and nitrogen are desirably as low as possible. In the production process of the magnet, contaminations of such elements cannot be avoided completely. An oxygen content of up to 1.5 at %, especially up to 1.2 at %, more preferably up to 1.0 at %, most preferably up to 0.8 at %, a carbon content of up to 0.5 at %, especially up to 0.4 at %, and a nitrogen content of up to 0.5 at %, especially up to 0.3 at % are permissible. The inclusion of up to 0.1 at % of other elements such as H, F, Mg, P, S, Cl and Ca as the impurity is permissible, and the content thereof is desirably as low as possible.

The balance is iron (Fe). The Fe content is preferably 70 to 80 at %, more preferably 75 to 80 at %.

An average grain size of the magnet is up to 6 μm, preferably 1.5 to 5.5 μm, and more preferably 2.0 to 5.0 μm, and an orientation of the c-axis of $R_2Fe_{14}B$ grains, which is an easy axis of magnetization, preferably is at least 98%. The average grain size is measured as follows. First, a cross-section of sintered magnet is polished, immersed into an etchant such as vilella solution (mixture of glycerol:nitric acid:hydrochloric acid=3:1:2) for selectively etching the grain boundary phase, and observed under a laser microscope. On analysis of the image, the cross-sectional area of individual grains is determined, from which the diameter of an equivalent circle is computed. Based on the data of area fraction of each grain size, the average grain size is determined. The average grain size is the average of about 2,000 grain sizes at the different 20 images. The average grain size of the sintered body is controlled by reducing the average particle size of the fine powder during pulverizing.

The microstructure of the magnet contains $R_2(Fe, (Co))_{14}B$ phase as a main phase, and R—Fe(Co)-$M_1$ phase and R-$M_1$ phase as a grain boundary phase. The R—Fe(Co)-$M_1$ phase accounts for preferably at least 1% by volume. If the R—Fe(Co)-$M_1$ grain boundary phase is less than 1 vol %, a enough high coercivity cannot be obtained. The R—Fe(Co)-$M_1$ grain boundary phase is desirably present in a proportion of 1 to 20% by volume, more desirably 1 to 10% by volume. If the R—Fe(Co)-$M_1$ grain boundary phase is more than 20 vol %, there may be accompanied a substantial loss of remanence. Herein, the main phase is preferably free of a solid solution of an element other than the above-identified elements. Also R-$M_1$ phase may coexist. Notably precipitation of $R_2(Fe, (Co))_{17}$ phase is not confirmed. Also the magnet contains $M_2$ boride phase at the grain boundary triple junction, but not $R_{1.1}Fe_4B_4$ compound phase. R-rich phase, and phases formed from inevitable elements included in the production process of the magnet such as R oxide, R nitride, R halide and R acid halide may be contained.

The R—Fe(Co)-$M_1$ grain boundary phase is a compound containing Fe or Fe and Co, and considered as an intermetallic compound phase having a crystal structure of space group I4/mcm, for example, $R_6Fe_{13}Ga_1$. On quantitative analysis by electron probe microanalyzer (EPMA), this phase consists of 25 to 35 at % of R, 2 to 8 at % of $M_1$, 0 to 8 at % of Co, and the balance of Fe, the range being inclusive of measurement errors. A Co-free magnet composition may be contemplated, and in this case, as a matter of course, neither the main phase nor the R—Fe(Co)-$M_1$ grain boundary phase contains Co. The R—Fe(Co)-$M_1$ grain boundary phase is distributed around main phases such that neighboring main phases are magnetically divided, leading to an enhancement in the coercivity.

In the R—Fe(Co)-$M_1$ phase, it is preferred that $M_1$ consist of 0.5 to 50 at % (based on $M_1$) of Si and the balance of at least one element selected from the group consisting of Al, Mn, Ni, Cu, Zn, Ga, Ge, Pd, Ag, Cd, In, Sn, Sb, Pt, Au, Hg, Pb, and Bi; 1.0 to 80 at % (based on $M_1$) of Ga and the balance of at least one element selected from the group consisting of Si, Al, Mn, Ni, Cu, Zn, Ge, Pd, Ag, Cd, In, Sn, Sb, Pt, Au, Hg, Pb, and Bi; or 0.5 to 50 at % (based on $M_1$) of Al and the balance of at least one element selected from the group consisting of Si, Mn, Ni, Cu, Zn, Ga, Ge, Pd, Ag, Cd, In, Sn, Sb, Pt, Au, Hg, Pb, and Bi. These elements can form stable intermetallic compounds such as $R_6Fe_{13}Ga_1$ and $R_6Fe_{13}Si_1$ as mentioned above, and are capable of relative substitution at $M_1$ site. Multiple additions of such elements at $M_1$ site does not bring a significant difference in magnetic properties, but in practice, achieves stabilization of magnet quality by reducing the variation of magnetic properties and a cost reduction by reducing the amount of expensive elements.

The width of the R—Fe(Co)-$M_1$ phase in intergranular grain boundary is preferably at least 10 nm, more preferably 10 to 500 nm, even more preferably 20 to 300 nm. If the width of the R—Fe(Co)-$M_1$ is less than 10 nm, a coercivity enhancement effect due to magnetic decoupling is not obtainable. Also preferably the width of the R—Fe(Co)-$M_1$ grain boundary phase is at least 50 nm on an average, more preferably 50 to 300 nm, and even more preferably 50 to 200 nm.

The R—Fe(Co)-$M_1$ phase intervenes between neighboring $R_2Fe_{14}B$ main phases as intergranular grain boundary phase, and is distributed around main phase so as to cover the main phase, that is, forms a core/shell structure with the main phase. A ratio of surface area coverage of the R—Fe(Co)-$M_1$ phase relative to the main phase is at least 50%, preferably at least 60%, and more preferably at least 70%, and the R—Fe(Co)-$M_1$ phase may even cover overall the main phase. The balance of the intergranular grain boundary phase around the main phase is R-$M_1$ phase containing at least 50% of R.

The crystal structure of the R—Fe(Co)-$M_1$ phase is amorphous, nano-crystalline or nano-crystalline including amorphous while the crystal structure of the R-$M_1$ phase is crystalline or nano-crystalline including amorphous. Preferably nano-crystalline grains have a size of up to 10 nm. As crystallization of the R—Fe(Co)-$M_1$ phase proceeds, the R—Fe(Co)-$M_1$ phase agglomerates at the grain boundary triple junction, and the width of the intergranular grain boundary phase becomes thinner and discontinuous, as a result the coercivity of the magnet decrease significantly. Also as crystallization of the R—Fe(Co)-$M_1$ phase proceeds, R-rich phase may form at the interface between the main phase and the grain boundary phase as the by-product of peritectic reaction, but the formation of the R-rich phase itself does not contribute to a substantial improvement in the coercivity.

The crystal orientation of the sintered magnet is at least 98%. The crystal orientation was measured by EBSD method (Electron Back Scatter Diffraction Patterns). The method is a technique to analyze a crystal orientation in a localized area by using an electron back scattering pattern (Kikuchi line). The scattering pattern is obtained by focusing electron beams onto the surface of a sample. The distribution of orientations of a main phase particle is measured by scanning the surface of a sample. The crystal orientation was measured as follows.

The distribution of orientations in all the pixels of the main phase area was measured in c-plane of the sintered magnet by a step size of 0.5 μm. Measuring points other than the main phase (e.g., grain boundary phase) was removed, and frequency distribution of tilted angles (θ) from orientation direction of the main phase was calculated.

The crystal orientation was quantified by the following formula:

$$\text{Crystal orientation (\%)}=(\Sigma\cos\theta i)/(\text{Number of measuring point}).$$

The sintered magnet has a degree of magnetization of at least 96%, preferably at least 97%, provided that the degree of the magnetization is defined as a ratio of magnetic polarizations, (I_a_Pc)/(I_f_Pc), and I_a_Pc stands for a magnetic polarization at Pc=1 after applying 640 kA/m and I_f_Pc stands for a magnetic polarization at Pc=1 after applying 1,590 kA/m.

Now the method for preparing an R—Fe—B base sintered magnet having the above-defined structure is described. The method generally involves grinding and milling of a mother alloy, pulverizing a coarse powder, compaction into a green body applying an external magnetic field, and sintering.

The mother alloy is prepared by melting raw metals or alloys in vacuum or an inert gas atmosphere, preferably argon atmosphere, and casting the melt into a flat mold or book mold or strip casting. If primary crystal of α-Fe is left in the cast alloy, the alloy may be heat-treated at 700 to 1,200° C. for at least one hour in vacuum or in an Ar atmosphere to homogenize the microstructure and to erase α-Fe phases.

The cast alloy is crushed or coarsely grinded to a size of typically 0.05 to 3 mm, especially 0.05 to 1.5 mm. The crushing step generally uses a Brown mill or hydrogen decrepitation. For the alloy prepared by strip casting, hydrogen decrepitation is preferred. The coarse powder is then pulverized on a jet mill by a high-pressure nitrogen gas, for example, into a fine particle powder with a particle size of typically 0.2 to 30 μm, especially 0.5 to 20 μm, more especially up to 10 μm on an average. If desired, a lubricant or other additives may be added in any of crushing, milling and pulverizing processes.

Binary alloy method is also applicable to the preparation of the magnet alloy power. In this method, a mother alloy with a composition of approximate to the $R_2$-$T_{14}$-$B_1$ and a sintering aid alloy with R-rich composition are prepared respectively. The alloy is milled into the coarse powder independently, and then mixture of alloy powder of mother alloy and sintering aid is pulverized as well as above mentioned. To prepare the sintering aid alloy, not only the casting technique mentioned above, but also the melt span technique may be applied.

The composition of the alloy is essentially 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta and W, 4.8+2×m to 5.9+2×m at % of B wherein m stands for atomic concentration of $M_2$, up to 10 at % of Co, and the balance of Fe.

The fine powder having an average particle size of up to 10 μm, preferably up to 5 μm, more preferably 2.0 to 3.5 μm above obtained is compacted under an external magnetic field by a compression molding machine. The green compact is then sintered in a furnace in vacuum or in an inert gas atmosphere typically at a temperature of 900 to 1,250° C., preferably 1,000 to 1,150° C. for 0.5 to 5 hours.

In a first embodiment of the method for preparing a sintered magnet having the above-defined structure, the compact as sintered above is cooled to a temperature of 400° C. or below, especially 300° C. or below, typically room temperature. The cooling rate is preferably 5 to 100° C./min, more preferably 5 to 50° C./min, though not limited thereto. After sintering, the sintered compact is heated at a temperature in the range of 700 to 1,100° C. which temperature is exceeding peritectic temperature of R—Fe(Co)-$M_1$ phase. (It is called post-sintering heat treatment.) The heating rate is preferably 1 to 20° C./min, more preferably 2 to 10° C./min, though not limited thereto. The peritectic temperature depends on the additive elements of $M_1$. For example, the peritectic temperature is 640° C. at $M_1$=Cu, 750 to 820° C. at $M_1$=Al, 850° C. at $M_1$=Ga, 890° C. at $M_1$=Si, and 1,080° C. at $M_1$=Sn. The holding time at the temperature is preferably at least 1 hour, more preferably 1 to 10 hours, and even more preferably 1 to 5 hours. The heat treatment atmosphere is preferably vacuum or an inert gas atmosphere such as Ar gas.

After the post-sintering heat treatment, the sintered compact is cooled down to a temperature of 400° C. or below, preferably 300° C. or below. The cooling rate down to 400° C. or below is 5 to 100° C./min, preferably 5 to 80° C./min, and more preferably 5 to 50° C./min. If the cooling rate is less than 5° C./min, then R—Fe(Co)-$M_1$ phase segregates at the grain boundary triple junction, and magnetic properties are degraded substantially. A cooling rate of more than 100° C./min is effective for inhibiting precipitation of R—Fe(Co)-$M_1$ phase during the cooling, but the dispersion of R-$M_1$ phase in the microstructure is insufficient. As a result, squareness of the sintered magnet becomes worse.

The aging treatment is performed after post-sintering heat treatment. The aging treatment is desirably carried out at a temperature of 400 to 600° C., more preferably 400 to 550° C., and even more preferably 450 to 550° C., for 0.5 to 50 hours, more preferably 0.5 to 20 hours, and even more preferably 1 to 20 hours, in vacuum or an inert gas atmosphere such as Ar gas. The temperature is lower than the peritectic temperature of R—Fe(Co)-$M_1$ phase so as to form the R—Fe(Co)-$M_1$ phase at a grain boundary. If the aging temperature is blow 400° C., a reaction rate of forming R—Fe(Co)-$M_1$ phase is too slow. If the aging temperature is above 600° C., the reaction rate to form R—Fe(Co)-$M_1$ phase increases significantly so that the R—Fe(Co)-$M_1$ grain boundary phase segregates at the grain boundary triple junction, and magnetic properties are degraded substantially. The heating rate to a temperature in the range of 400 to 600° C. is preferably 1 to 20° C./min, more preferably 2 to 10° C./min, though not limited thereto.

In a second embodiment of the method for preparing a sintered magnet having the above-defined structure, the compact as sintered above is cooled to a temperature of 400° C. or below, especially 300° C. or below. The cooling rate is critical. The sintered compact is cooled down to a temperature of 400° C. or below at a cooling rate of 5 to 100° C./min, preferably 5 to 50° C./min. If the cooling rate is less than 5° C./min, then R—Fe(Co)-$M_1$ phase segregates at the grain boundary triple junction, and magnetic properties are substantially degraded. A cooling rate of more than 100° C./min is effective for inhibiting precipitation of R—Fe(Co)-$M_1$ phase during the cooling, but the dispersion of R-$M_1$ phase in the microstructure is insufficient. As a result, squareness of the sintered magnet becomes worse.

After the sintered compact is cooled as above described, aging treatment is carried out as well as the first embodiment of the method. That is, the aging treatment is by holding the sintered compact at a temperature in the range of 400 to 600° C. and not higher than the peritectic temperature of R—Fe(Co)-$M_1$ phase so as to form the R—Fe(Co)-$M_1$ phase at a grain boundary. If the aging temperature is blow 400° C., a reaction rate to form R—Fe(Co)-$M_1$ phase is too slow. If the aging temperature is above 600° C., the reaction rate to form R—Fe(Co)-$M_1$ phase increases significantly so that the R—Fe(Co)-$M_1$ grain boundary phase segregates at the grain boundary triple junction, and magnetic properties are substantially degraded. The aging time is preferably 0.5 to 50 hours, more preferably 0.5 to 20 hours, and even more preferably 1 to 20 hours in vacuum or an inert gas atmosphere such as Ar gas. The heating rate to a temperature in the range of 400 to 600° C. is preferably 1 to 20° C./min, more preferably 2 to 10° C./min, though not limited thereto.

EXAMPLE

Examples are given below for further illustrating the invention although the invention is not limited thereto.

Examples 1 to 12 & Comparative Examples 1 to 7

The alloy was prepared specifically by using rare earth metals (Neodymium or Didymium), electrolytic iron, Co, ferro-boron and other metals and alloys, weighing them with a designated composition, melting at high-frequency induction furnace in an Ar atmosphere, and casting the molten alloy on the water-cooling copper roll. The thickness of the obtained alloy was about 0.2 to 0.3 mm. The alloy was powdered by the hydrogen decrepitation process, that is, hydrogen absorption at normal temperature and subsequent heating at 600° C. in vacuum for hydrogen desorption. A stearic acid as lubricant with the amount of 0.07 wt % was added and mixed to the coarse alloy powder. The coarse powder was pulverized into a fine powder with a particle size of about 3 μm on an average by using a jet milling machine with a nitrogen jet stream. Fine powder was molded while applying a magnetic field of 15 kOe for orientation. The green compact was sintered in vacuum at 1,050 to 1,100° C. for 3 hours, and cooled below 200° C. The sintered body was post-sintered at 900° C. for 1 hour, cooled to 200° C., and heat-treated for aging for 2 hours. Table 1 tabulates the composition of a magnet, although oxygen, nitrogen and carbon concentrations are shown in Table 2. The condition of the heat treatment such as a cooling rate from 900° C. to 200° C., aging treatment temperature, and magnetic properties are shown in Table 2. The composition of R—Fe(Co)-$M_1$ phase is shown in Table 3.

Also reported are a crystal orientation, a degree of magnetization at Pc=1 under an applied magnetic field of 8 kOe, and an average grain size of the sintered body.

It is noted that the magnetization was determined using a BH tracer. First a magnet block of 10 mm×10 mm×12 mmT was mounted between pole pieces of the BH tracer, whereupon an external magnetic field of 8 kOe was applied in a positive direction. The sweeping direction of the external magnetic field was reversed, external magnetic field was applied in the reverse direction until −25 kOe. A demagnetization curve was plotted, from which a magnetization value (I_a_Pc) at Pc=1 was determined. Next, the magnet block was taken out of the BH tracer, fully magnetized by a pulse magnetization machine under a magnetic field of 80 kOe. Thereafter, using the BH tracer again, a demagnetization curve was plotted, from which a magnetization value (I_f_c) at Pc=1 was determined. The degree of magnetization was computed according to the equation.

$$\text{Degree of magnetization (\%)}=[(I_a_Pc)/(I_f_Pc)]\times 100$$

TABLE 1

| | | Nd (at %) | Pr (at %) | Dy (at %) | Fe (at %) | Co (at %) | B (at %) | Al (at %) | Cu (at %) | Zr (at %) | Si (at %) | Ga (at %) | Sn (at %) |
|---|---|---|---|---|---|---|---|---|---|---|---|---|---|
| Example | 1 | 11.6 | 3.4 | | bal. | 0.5 | 5.4 | 0.2 | 0.2 | 0.07 | 0.05 | 0.80 | |
| | 2 | 11.6 | 3.4 | | bal. | 0.5 | 5.4 | 0.5 | 0.2 | 0.07 | 0.05 | 0.50 | |
| | 3 | 11.6 | 3.4 | | bal. | 1.0 | 5.2 | 0.5 | 0.2 | 0.07 | 0.50 | 0.50 | |
| | 4 | 11.6 | 3.4 | | bal. | 1.0 | 5.2 | 0.5 | 0.7 | 0.07 | 0.25 | 0.25 | |
| | 5 | 11.6 | 3.4 | | bal. | 0.5 | 5.4 | 0.2 | 0.2 | 0.07 | 0.05 | 0.80 | |
| | 6 | 11.6 | 3.4 | | bal. | 0.5 | 5.1 | 0.2 | 0.2 | 0.07 | 0.05 | 0.80 | |
| | 7 | 11.6 | 3.4 | | bal. | 0.5 | 5.4 | 0.5 | 0.5 | 0.07 | 0.05 | 0.50 | |

TABLE 1-continued

| | | | | | | | | | | | | |
|---|---|---|---|---|---|---|---|---|---|---|---|---|
| 8 | 11.6 | 3.4 | | bal. | 0.5 | 5.4 | 0.5 | 0.5 | 0.07 | 0.05 | 0.50 | |
| 9 | 11.5 | 3.3 | 0.2 | bal. | 0.5 | 5.4 | 0.2 | 0.2 | 0.15 | 0.20 | 0.50 | |
| 10 | 11.5 | 3.3 | 0.2 | bal. | 0.5 | 5.5 | 0.2 | 0.2 | 0.30 | 0.20 | 0.50 | |
| 11 | 11.3 | 3.2 | 0.5 | bal. | 0.5 | 5.2 | 0.2 | 0.2 | 0.15 | 0.10 | 0.50 | 0.10 |
| 12 | 11.0 | 3.0 | 0.2 | bal. | 0.5 | 5.4 | 0.2 | 0.2 | 0.15 | 0.10 | 0.50 | |

| | | Nd (at %) | Pr (at %) | Fe (at %) | Co (at %) | B (at %) | Al (at %) | Cu (at %) | Zr (at %) | Si (at %) | Ga (at %) | Sn (at %) |
|---|---|---|---|---|---|---|---|---|---|---|---|---|
| Comparative Example | 1 | 12.0 | 3.8 | bal. | 1.0 | 5.3 | | | | | | |
| | 2 | 11.6 | 3.4 | bal. | 0.5 | 5.4 | 0.5 | 0.2 | 0.07 | 0.05 | 0.50 | |
| | 3 | 11.6 | 3.4 | bal. | 1.0 | 5.2 | 0.5 | 0.7 | 0.07 | 0.25 | 0.25 | |
| | 4 | 11.6 | 3.4 | bal. | 0.5 | 6.2 | 0.2 | 0.2 | 0.07 | | 0.80 | |
| | 5 | 11.6 | 3.4 | bal. | 0.5 | 5.4 | 0.5 | 0.2 | 0.07 | 0.05 | 0.50 | |
| | 6 | 11.6 | 3.4 | bal. | 0.5 | 5.4 | 0.5 | 0.2 | 0.07 | 0.05 | 0.50 | |
| | 7 | 11.6 | 3.4 | bal. | 1.0 | 5.2 | 0.5 | 5.0 | | | 0.20 | |

TABLE 2

| | | Oxygen concentration (at %) | Nitrogen concentration (at %) | Carbon concentration (at %) | Particle size (μm) | Cooling rate (° C./min) | Temperature of aging treatment (° C.) | Br (kG) | HcJ (kOe) | Average thickness of intergranular grain boundary (nm) |
|---|---|---|---|---|---|---|---|---|---|---|
| Example | 1 | 0.75 | 0.09 | 0.06 | 2.9 | 25 | 450 | 13.3 | 20.5 | 280 |
| | 2 | 0.62 | 0.09 | 0.06 | 2.9 | 25 | 450 | 13.4 | 19.5 | 290 |
| | 3 | 0.66 | 0.06 | 0.06 | 3.8 | 25 | 450 | 13.0 | 18.5 | 300 |
| | 4 | 0.79 | 0.06 | 0.06 | 2.8 | 25 | 500 | 13.3 | 17.5 | 270 |
| | 5 | 0.75 | 0.06 | 0.06 | 2.8 | 25 | 500 | 13.3 | 20.0 | 260 |
| | 6 | 0.66 | 0.06 | 0.06 | 2.8 | 25 | 500 | 13.1 | 21.5 | 300 |
| | 7 | 0.54 | 0.09 | 0.06 | 2.9 | 10 | 450 | 13.3 | 19.5 | 260 |
| | 8 | 0.75 | 0.06 | 0.06 | 2.9 | 5 | 450 | 13.3 | 19.0 | 230 |
| | 9 | 0.60 | 0.06 | 0.06 | 2.9 | 20 | 450 | 13.0 | 21.0 | 200 |
| | 10 | 0.62 | 0.06 | 0.06 | 2.9 | 20 | 450 | 12.9 | 22.5 | 180 |
| | 11 | 0.60 | 0.06 | 0.06 | 2.9 | 20 | 450 | 12.9 | 24.0 | 150 |
| | 12 | 0.61 | 0.06 | 0.06 | 2.9 | 20 | 450 | 13.7 | 20.0 | 140 |
| Comparative Example | 1 | 1.65 | 0.06 | 0.38 | 4.5 | 25 | 500 | 13.6 | 9.5 | <5 |
| | 2 | 1.04 | 0.06 | 0.36 | 2.9 | 2 | 500 | 13.2 | 12.5 | 300 |
| | 3 | 0.95 | 0.06 | 0.33 | 2.8 | 2 | 650 | 12.9 | 12.0 | 280 |
| | 4 | 0.91 | 0.06 | 0.33 | 2.8 | 25 | 490 | 13.5 | 16.0 | <5 |
| | 5 | 1.04 | 0.06 | 0.36 | 2.9 | 25 | 650 | 13.0 | 17.0 | 300 |
| | 6 | 1.04 | 0.06 | 0.33 | 2.9 | 25 | 850 | 13.6 | 12.0 | <5 |
| | 7 | 0.87 | 0.06 | 0.33 | 3.0 | 25 | 500 | 12.6 | 12.0 | <5 |

| | | Surface area coverage (%) | R—Fe(Co)—$M_1$ phase | R—$M_1$ phase | $R_{1.1}Fe_4B_4$ phase | Average grain size (μm) | Degree of magnetization (%) | Orientation (%) |
|---|---|---|---|---|---|---|---|---|
| Example | 1 | 95 | A + NC | NC | nil | 3.8 | 98.1 | 98.2 |
| | 2 | 95 | A + NC | NC | nil | 3.8 | 98.6 | 98.2 |
| | 3 | 95 | A + NC | NC | nil | 4.9 | 98.0 | 98.5 |
| | 4 | 90 | A + NC | NC | nil | 3.6 | 98.0 | 98.2 |
| | 5 | 90 | A + NC | NC | nil | 3.6 | 98.5 | 98.2 |
| | 6 | 95 | A + NC | NC | nil | 3.6 | 98.3 | 98.2 |
| | 7 | 95 | A + NC | NC | nil | 3.8 | 98.6 | 98.2 |
| | 8 | 95 | A + NC | NC | nil | 3.8 | 98.6 | 98.2 |
| | 9 | 90 | A + NC | NC | nil | 4.0 | 98.5 | 98.3 |
| | 10 | 90 | A + NC | NC | nil | 4.1 | 98.4 | 98.3 |
| | 11 | 90 | A + NC | NC | nil | 4.3 | 99.0 | 98.3 |
| | 12 | 90 | A + NC | NC | nil | 4.2 | 97.6 | 98.3 |
| Comparative Example | 1 | <5 | nil | NC | nil | 5.9 | 94.5 | |
| | 2 | 30 | A + NC | NC | nil | 3.8 | 94.8 | |
| | 3 | 30 | A + NC | NC | nil | 3.6 | 95.1 | |
| | 4 | <5 | nil | NC | found | 3.6 | 94.8 | |
| | 5 | 40 | A + NC | NC | nil | 3.8 | 95.8 | |
| | 6 | <5 | nil | NC | nil | 3.8 | 95.1 | |
| | 7 | <5 | nil | NC | nil | 3.9 | 94.1 | |

A: amorphous

NC: nanocrystalline (up to 10 nm)

TABLE 3

| | | R—Fe(Co)—$M_1$ phase (at %) | | | | | | | | | |
|---|---|---|---|---|---|---|---|---|---|---|---|
| | | Nd | Pr | Dy | Fe | Co | Cu | Al | Ga | Si | Sn |
| Example | 1 | 21.9 | 7.1 | | 61.4 | 1.3 | 0.6 | 1.0 | 4.3 | 0.1 | |
| | 2 | 21.5 | 6.9 | | 62.3 | 1.4 | 0.8 | 0.9 | 5.1 | 0.1 | |
| | 3 | 22.3 | 7.6 | | 59.8 | 1.8 | 0.7 | 1.0 | 2.9 | 2.5 | |
| | 4 | 22.8 | 7.2 | | 59.7 | 1.6 | 0.9 | 0.8 | 3.2 | 2.1 | |
| | 5 | 22.2 | 7.1 | | 61.7 | 1.2 | 0.8 | 0.9 | 5.0 | 0.1 | |
| | 6 | 21.7 | 7.0 | | 62.4 | 1.1 | 0.8 | 0.8 | 4.8 | 0.1 | |
| | 7 | 22.5 | 7.1 | | 61.3 | 1.1 | 0.9 | 1.0 | 5.2 | 0.1 | |
| | 8 | 22.3 | 7.0 | | 61.1 | 1.2 | 0.8 | 1.0 | 5.1 | 0.1 | |
| | 9 | 22.7 | 7.4 | 0.3 | 59.8 | 1.1 | 0.7 | 0.7 | 3.2 | 1.2 | |
| | 10 | 21.3 | 6.7 | 0.4 | 61.0 | 1.1 | 0.7 | 0.7 | 3.5 | 1.1 | |
| | 11 | 21.7 | 6.5 | 0.7 | 61.2 | 1.1 | 0.7 | 0.6 | 3.8 | 0.5 | 2.1 |
| | 12 | 21.7 | 6.9 | 0.3 | 61.5 | 1.0 | 0.7 | 1.0 | 4.5 | 0.5 | |

The content of R in R-$M_1$ phase was 50 to 92 at %.

Figure 2A:
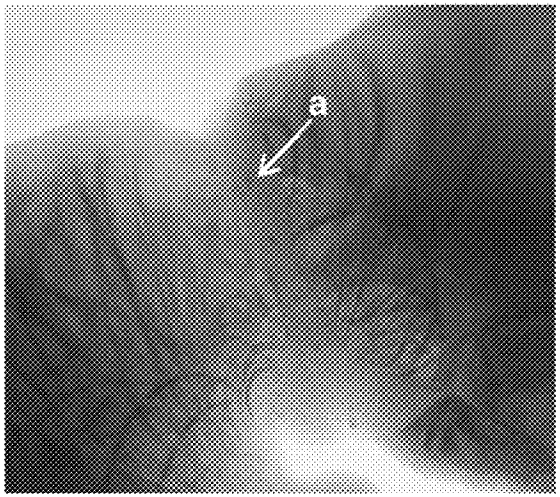
FIG. 2*a* is an electron image of grain boundary phase in the sintered magnet in Example 1, observed under TEM.
Figure 2B:
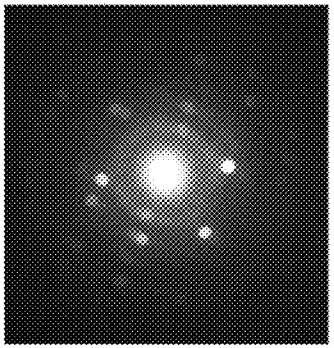
FIG. 2*b* is an electron beam diffraction pattern at point "a" in FIG. 2*a*.

A cross section of the sintered magnet obtained in Example 1 was observed under an electron probe microanalyzer (EPMA). As shown in FIG. 1, a grain boundary phase (R—Fe(Co)-$M_1$ phase, R-$M_1$ phase) covering a main phase ($R_2(Fe,Co)_{14}B$) was observed. Further, the grain boundary phase covering the main phase was observed under a transmission electron microscope (TEM). As shown in FIG. 2*a*, the grain boundary phase had a thickness (or phase width) of about 200 nm. The EDX and the diffraction image of FIG. 2*b* at point "a" in FIG. 2*a* demonstrate the presence of $R_3(CoGa)_1$ phase and R—Fe(Co)-$M_1$ phase which are amorphous or nanocrystalline. In Examples, $ZrB_2$ phase formed during sintering and precipitated at the grain boundary triple junction.

Figure 3:
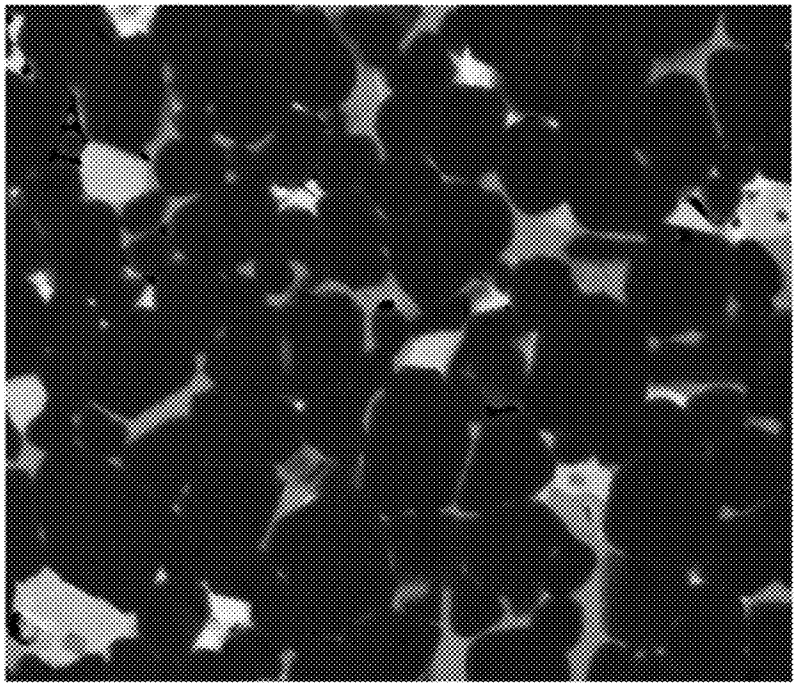
FIG. 3 is a Back scatter electron image in cross section of a sintered magnet in Comparative Example 2, observed under EPMA.

FIG. 3 is an image of a cross section of the sintered magnet in Comparative Example 2 as observed under EPMA. Since the cooling rate of the post-sintering heat treatment was too slow, the R—Fe(Co)-$M_1$ phase was discontinuous at the intergranular grain boundary and segregates corpulently at the grain boundary triple junction.

Example 13

The alloy was prepared specifically by using rare earth metals (Neodymium or Didymium), electrolytic iron, Co, ferro-boron and other metals and alloys, weighing them with the same composition as in Example 1, melting at high-frequency induction furnace in an Ar atmosphere, and casting the molten alloy on the water-cooling copper roll. The thickness of the obtained alloy was about 0.2 to 0.3 mm. The alloy was powdered by the hydrogen decrepitation process, that is, hydrogen absorption at normal temperature and subsequent heating at 600° C. in vacuum for hydrogen desorption. A stearic acid as lubricant with the amount of 0.07 wt % was added and mixed to the coarse alloy powder. The coarse powder was pulverized into a fine powder with a particle size of about 3 μm on an average by using a jet milling machine with a nitrogen jet stream. Fine powder was molded while applying a magnetic field of 15 kOe for orientation. The green compact was sintered in vacuum at 1,080° C. for 3 hours, and cooled below 200° C. at a cooling rate of 25° C./min. Then, the sintered body was heat-treated for aging at 450° C. for 2 hours. The aging treatment temperature, and magnetic properties are shown in Table 1. The composition of R—Fe(Co)-$M_1$ phase was substantially the same as in Example 1.

TABLE 4

| | Oxygen concentration (at %) | Nitrogen concentration (at %) | Carbon concentration (at %) | Particle size (μm) | Cooling rate (° C./min) | Temperature of aging treatment (° C.) | Br (kG) | HcJ (kOe) | Average thickness of intergranular grain boundary (nm) |
|---|---|---|---|---|---|---|---|---|---|
| Example 13 | 0.75 | 0.09 | 0.06 | 2.9 | 25 | 450 | 13.3 | 20.0 | 250 |

| | Surface area coverage (%) | R—Fe(Co)—$M_1$ phase | R—$M_1$ phase | $R_{1.1}Fe_4B_4$ phase | Average grain size (μm) | Degree of magnetization (%) | Orientation (%) |
|---|---|---|---|---|---|---|---|
| Example 13 | 95 | A + NC | NC | nil | 3.8 | 98.1 | 98.2 |

A: amorphous
NC: nanocrystalline (up to 10 nm)

Japanese Patent Application Nos. 2015-072287 and 2016-025531 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An R-Fe-B base sintered magnet of a composition consisting essentially of 12 to 17 at % of R which is at least Nd and Pr, and optionally one or more elements selected from a group consisting of yttrium and rare earth elements other than Nd and Pr, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta, and W, 4.8+2× m to 5.9+2× m at % of B wherein m stands for atomic concentration of $M_2$, up to 10 at % of Co, up to 0.5 at % of carbon, up to 1.5 at % of oxygen, up to 0.5 at % of nitrogen, and the balance of Fe, the R-Fe-B base sintered magnet containing $R_2(Fe,(Co))_{14}B$ intermetallic compound as a main phase, and having a coercivity of at least 10 kOe at room temperature, wherein the magnet contains a $M_2$ boride phases at grain boundary triple junctions, but not including $R_{1.1}Fe_4B_4$ compound phase, has a core/shell structure that the main phase is covered with a grain boundary phases comprising an amorphous and/or sub-10 nm nanocrystalline R-Fe(Co)-$M_1$ phase consisting essentially of 25 to 35 at % of R, 2 to 8 at % of $M_1$, up to 8 at % of Co, and the balance of Fe, or the R—Fe(Co)-$M_1$ phase and a crystalline or a sub-10 nm nano-crystalline and amorphous R-$M_1$ phase having at least 50 at % of R, wherein a surface area coverage of the R—Fe(Co)-$M_1$ phase on the main phase is at least 50%, the width of the intergranular grain boundary phase is at least 10 nm and at least 50 nm on the average, and the magnet as sintered has an average grain size of up to 6 μm, a crystal orientation of at least 98%, and a degree of magnetization of at least 96%, where the degree of the magnetization is defined as a ratio of magnetic polarizations, (I_a_Pc)/(I_f_Pc), and I_a_Pc stands for a magnetic polarization at Pc=1 after applying 640 kA/m and I_f_Pc stands for a magnetic polarization at Pc=1 after applying 1,590 kA/m.

2. The sintered magnet of claim 1 wherein in the R—Fe(Co)-$M_1$ phase, $M_1$ consists of 0.5 to 50 at % of Si and the balance of at least one element selected from the group consisting of Al, Mn, Ni, Cu, Zn, Ga, Ge, Pd, Ag, Cd, In, Sn, Sb, Pt, Au, Hg, Pb, and Bi.

3. The sintered magnet of claim 1 wherein in the R—Fe(Co)-$M_1$ phase, $M_1$ consists of 1.0 to 80 at % of Ga and the balance of at least one element selected from the group consisting of Si, Al, Mn, Ni, Cu, Zn, Ge, Pd, Ag, Cd, In, Sn, Sb, Pt, Au, Hg, Pb, and Bi.

4. The sintered magnet of claim 1 wherein in the R—Fe(Co)-$M_1$ phase, $M_1$ consists of 0.5 to 50 at % of Al and the balance of at least one element selected from the group consisting of Si, Mn, Ni, Cu, Zn, Ga, Ge, Pd, Ag, Cd, In, Sn, Sb, Pt, Au, Hg, Pb, and Bi.

5. The sintered magnet of claim 1 wherein a total content of Dy, Tb and Ho is 0 to 5.0 at %.

6. A method for preparing the R-Fe-B base sintered magnet of claim 1, comprising the steps of:

shaping an alloy powder having an average particle size of up to 10 μm into a green compact, the alloy powder being obtained by finely pulverizing an alloy consisting essentially of 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta and W, 4.8+2×m to 5.9+2×m at % of B wherein m stands for atomic concentration of $M_2$, up to 10 at % of Co, and the balance of Fe, sintering the green compact at a temperature of 1,000 to 1,150° C., cooling the sintered compact to a temperature of 400° C. or below, post-sintering heat treatment including heating the sintered compact at a temperature in the range of 700 to 1,100° C. which temperature is exceeding peritectic temperature of R—Fe(Co)-$M_1$ phase, and cooling down to a temperature of 400° C. or below at a rate of 5 to 100° C./min, and aging treatment including exposing the sintered compact at a temperature in the range of 400 to 600° C. which temperature is lower than the peritectic temperature of R—Fe(Co)-$M_1$ phase so as to form the R—Fe(Co)-$M_1$ phase at a grain boundary, and cooling down to a temperature of 200° C. or below.

7. A method for preparing the R-Fe-B base sintered magnet of claim 1, comprising the steps of:

shaping an alloy powder having an average particle size of up to 10 m into a green compact, the alloy powder being obtained by finely pulverizing an alloy consisting essentially of 12 to 17 at % of R which is at least two of yttrium and rare earth elements and essentially contains Nd and Pr, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta and W, 4.8+2×m to 5.9+2×m at % of B wherein m stands for atomic concentration of $M_2$, up to 10 at % of Co, and the balance of Fe, sintering the green compact at a temperature of 1,000 to 1,150° C., cooling the sintered compact to a temperature of 400° C. or below at a rate of 5 to 100° C./min, and aging treatment including exposing the sintered compact at a temperature in the range of 400 to 600° C. which temperature is lower than the peritectic temperature of R—Fe(Co)-$M_1$ phase so as to form the R—Fe(Co)-$M_1$ phase at a grain boundary, and cooling down to a temperature of 200° C. or below.

8. The method of claim 6 wherein the alloy contains Dy, Tb and Ho in a total amount of 0 to 5.0 at %.

* * * * *